US008602013B2

(12) United States Patent
Bednar et al.

(10) Patent No.: US 8,602,013 B2
(45) Date of Patent: Dec. 10, 2013

(54) CROSSBOW WITH LIGHTED SAFETY MECHANISM

(75) Inventors: William J. Bednar, Akron, OH (US); Richard L. Bednar, legal representative, Munroe Falls, OH (US); Richard L. Bednar, Munroe Falls, OH (US)

(73) Assignee: Hunter's Manufacturing Company, Inc., Suffield, OH (US)

( * ) Notice: Subject to any disclaimer, the term of this patent is extended or adjusted under 35 U.S.C. 154(b) by 0 days.

(21) Appl. No.: 13/410,709

(22) Filed: Mar. 2, 2012

(65) Prior Publication Data

US 2012/0222661 A1 Sep. 6, 2012

Related U.S. Application Data

(60) Provisional application No. 61/449,268, filed on Mar. 4, 2011.

(51) Int. Cl.
*F41B 5/12* (2006.01)

(52) U.S. Cl.
USPC ..... 124/25; 124/40

(58) Field of Classification Search
USPC ..... 124/23.1, 25, 25.6, 40, 86, 88
See application file for complete search history.

(56) References Cited

U.S. PATENT DOCUMENTS

| | | | | | |
|---|---|---|---|---|---|
| 3,867,920 | A | * | 2/1975 | Westphal | 124/24.1 |
| 4,134,383 | A | * | 1/1979 | Flood | 124/25.6 |
| 4,572,153 | A | * | 2/1986 | MacPherson | 124/88 |
| 4,741,320 | A | * | 5/1988 | Wiard | 124/23.1 |
| 5,060,626 | A | * | 10/1991 | Elliott et al. | 124/86 |

* cited by examiner

*Primary Examiner* — John Ricci
(74) *Attorney, Agent, or Firm* — Emerson Thomson Bennett, LLC

(57) ABSTRACT

A crossbow may comprise a safety device that provides the user a visual means other than the mechanical positioning of the various components of the crossbow to quickly and accurately determine the firing condition of the crossbow. The safety device may comprise an illuminated marker that emits a specific color of light to denote the firing condition of the crossbow. In another embodiment, the safety device may comprise a mechanical assembly that is raised and lowered to denote the firing condition of the crossbow. In yet another embodiment, the safety device may comprise an electric switch that causes an illuminated marker to emit a light or a mechanical assembly to raise or lower in order to denote the firing condition of the crossbow.

9 Claims, 4 Drawing Sheets

CROSSBOW WITH LIGHTED SAFETY MECHANISM

I. BACKGROUND

A. Field of Invention

This invention pertains to the art of methods and apparatuses for safely discharging a crossbow device, and more specifically, to the art of methods and apparatuses for a safety device for providing a visual means for indicating the operative condition of the crossbow device.

B. Description of the Related Art

A crossbow is a weapon that can be used for hunting, fishing, target shooting, and the like. Conventionally, a crossbow comprises a stock, a bow, a bowstring, and a trigger assembly. Typically, the trigger assembly is mounted on the stock and includes a catch and a trigger lever. The catch holds the bowstring in the drawn position and is selectively held in place and released by the trigger lever. When the trigger lever is pulled, the drawn bowstring will be released from the catch and an arrow or projectile will be shot or fired. It is known to provide crossbows with a safety device to prevent the unintentional firing of the crossbow.

Although known methods work well for their intended purpose, several disadvantages exist. Conventional safety devices include safety devices that must be manually engaged and safety devices that are automatically engaged upon drawing the bowstring into the trigger mechanism. However, conventional safety devices offer only limited protection against crossbows being carelessly or negligently left unsafe, wherein the safety device is disengaged and the crossbow is in a condition for firing, and then carried in that condition. What is needed then is a safety device that provides a practical and convenient means for indicating the current condition for firing of the crossbow.

II. BRIEF DESCRIPTION OF THE DRAWINGS

The invention may take physical form in certain parts and arrangement of parts, a preferred embodiment of which will be described in detail in this specification and illustrated in the accompanying drawings which form a part hereof and wherein.

III. DETAILED DESCRIPTION

Figure 1:
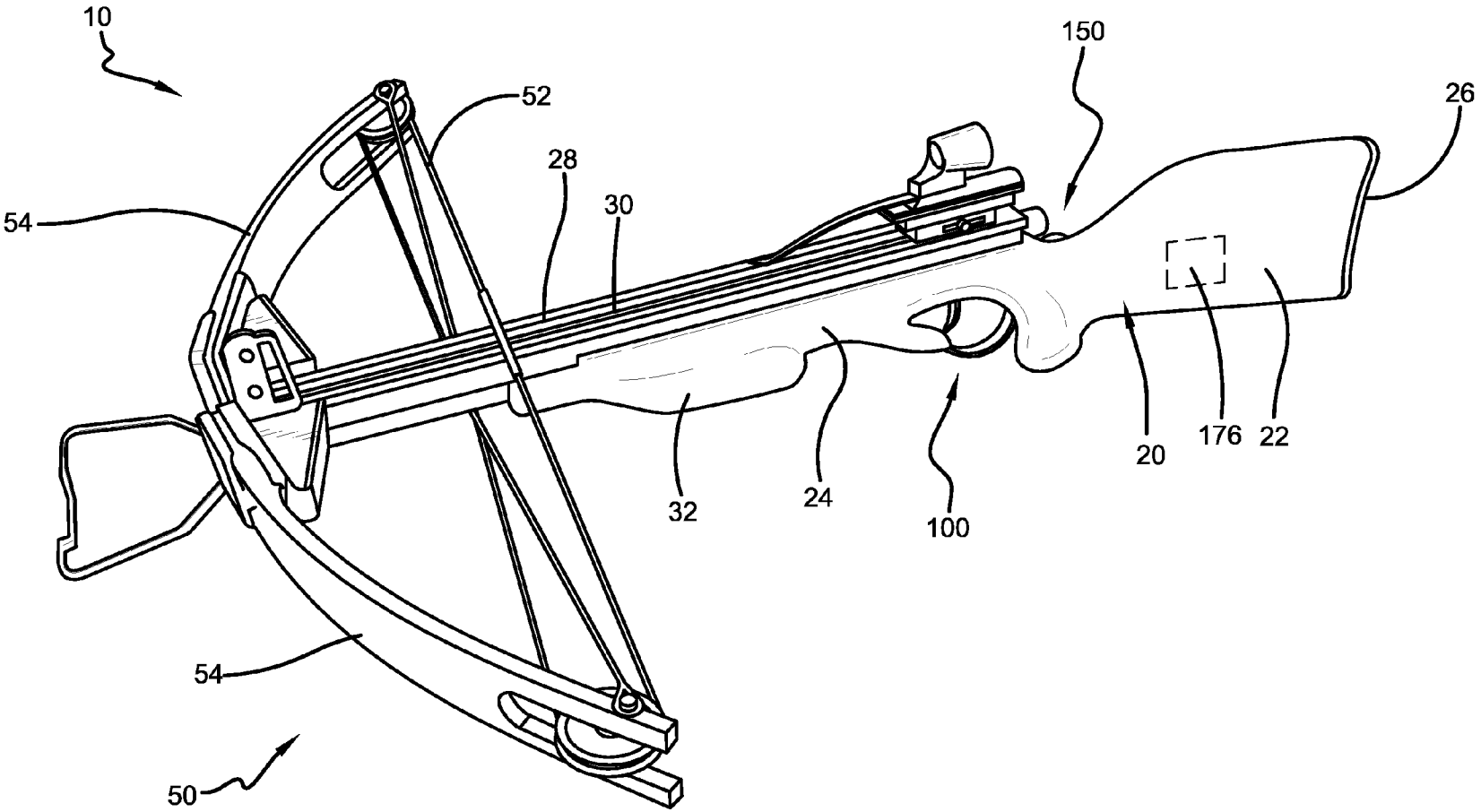
FIG. 1 shows a perspective view of a crossbow comprising a safety device according to one embodiment of the invention.

Referring now to the drawings wherein the showings are for purposes of illustrating embodiments of the invention only and not for purposes of limiting the same, FIG. 1 shows a crossbow 10 having a safety device 150 according to one embodiment of the invention. The safety device 150 provides the user a visual means other than the mechanical positioning of the various components of the crossbow 10 to quickly and accurately determine the firing condition of the crossbow 10. The firing condition of the crossbow 10 may refer to the mechanical positioning of the various crossbow components related to the firing of the crossbow. For example, the crossbow 10 may comprise a "safe position" or a safe firing condition when the safety device 150 is engaged such that the crossbow 10 is prevented from being fired. The crossbow 10 may comprise a "fire position" or a ready firing condition when the safety device 150 is not engaged and the crossbow 10 may be fired. Alternatively, the crossbow 10 may comprise a "ready firing condition" when the safety device 150 is not engaged, the crossbow 10 is in the drawn position, and an arrow or other projectile is properly positioned for firing. The safety device 150 may comprise an illuminated marker that emits a specific color of light to denote the firing condition of the crossbow 10. In another embodiment, the safety device 150 may comprise a mechanical assembly that is raised and lowered to denote the firing condition of the crossbow 10. In yet another embodiment, the safety device 150 may comprise an electric switch that causes an illuminated marker to emit a light or a mechanical assembly to raise or lower in order to denote the firing condition of the crossbow 10. The safety device 150 may comprise any visual means other than recognition or identification of the mechanical positioning of the various components of the crossbow for indicating to the user the firing condition of the crossbow. The firing conditions described herein have been chosen as an aid to understanding the present invention and are not intended to limit the present invention. It should also be understood that in accordance with the present invention, the safety device 150 may be used with any type of crossbow, and no limitations with regard to the configuration of the crossbow generally exist.

Figure 2:
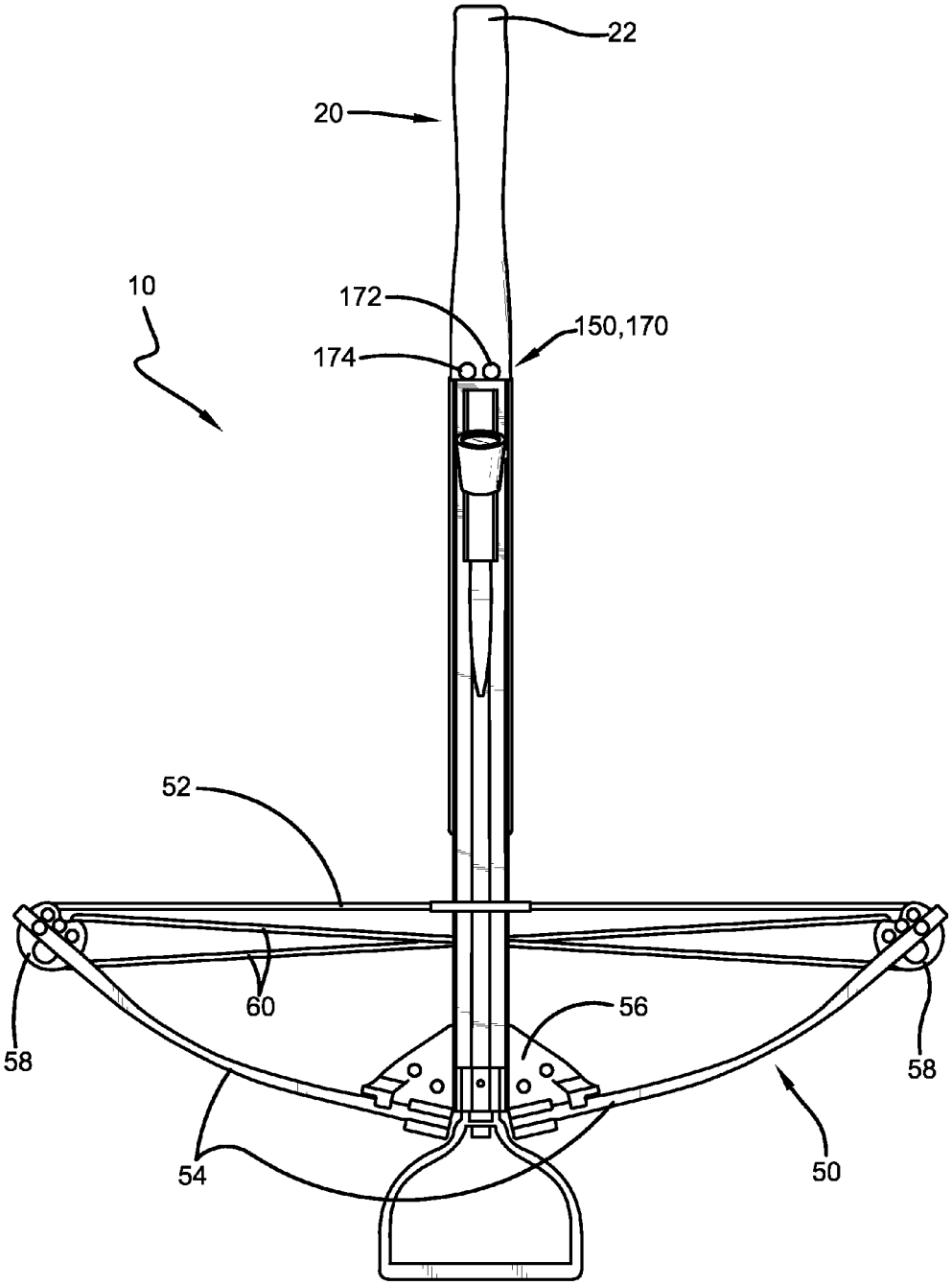
FIG. 2 shows a perspective top view of a crossbow comprising a safety device according to one embodiment of the invention.

With reference now to FIGS. 1 and 2, the crossbow 10 may generally include a stock member 20, a bow portion 50, and a trigger assembly 100. The trigger assembly 100 may be associated with the stock member 20 for selectively holding and releasing a bowstring 52. The bow portion 50 may comprise two outwardly extending limb members 54 that extend transversely on opposite sides from the stock member 20. The bowstring 52 may be strung between the distal ends of the limb members 54 such that as the bowstring 52 is drawn and held by the trigger assembly 100, the limb members 54 are tensioned, thereby storing energy that is released upon release of the bowstring 52 from the trigger assembly 100 to propel an arrow or other projectile. The stock member 20 may generally comprise a rear portion or tailstock 22 and a forestock or barrel 24. The tailstock 22 may comprise an integrally formed butt portion 26 that is normally positioned against the user's shoulder when the crossbow 10 is being aimed or fired. The barrel 24 may comprise a hollow, extruded member that provides added structural integrity to the crossbow 10 that is normally held by the user when the crossbow 10 is being aimed or fired. In one embodiment, the barrel 24 may comprise a separate member formed of a strong, lightweight material, such as aluminum. In another embodiment, the barrel 24 may be integral to the tailstock 22. The barrel 24 may comprise an upper surface 28, an arrow guide or channel 30, and a grip 32. The upper surface 28 may comprise a flat surface on which the bowstring 52 may slide in operation of the crossbow 10. The channel 30 may be a groove formed in the upper surface 28 of the barrel 24 that receives at least a portion of the arrow or projectile to be fired from the crossbow 10. For example, the channel 30 may receive a member of an arrow's fletching, which is commonly a plastic vane or feather, and acts as a guide to direct the arrow from the crossbow 10. While the arrow is being fired from the crossbow 10, the member of the arrow's fletching disposed within the channel 30 may also serve to guide the arrow towards the terminal end of the barrel 24. The grip 32 may be fashioned in the lower portion of the stock member 20 between the trigger assembly 100 and the bow portion 50. The grip 32 may comprise either a separate or integral component of the stock member 20. The grip 32 may allow the user to firmly grasp the forward end of the stock member 20 during operation and discharge of the crossbow 10.

With continued reference now to FIGS. 1 and 2, the bow portion 50 may comprise the limb members 54, a riser block assembly 56, and a cam assembly 58. The riser block assembly may be secured to the forward end of the barrel 24 and may support the limb members 54. The limb members 54 may comprise a single member, or two or more separate members each coupled to the crossbow 10 independently of the others. The cam assembly 58 may comprise a series of cams, pulleys, or wheels coupled to the distal ends of the limb members 54. The series of cams may comprise oblong shaped pulley mechanisms over which the bowstring 52 travels as it is drawn and released. The series of cams may rotate as the bowstring 52 is drawn and released. Once the bowstring 52 is drawn passed a predetermined point rearward towards tailstock 22 of the stock member 20, the cam assembly 58 may serve to minimize the force that must be imparted on the bowstring 52 to maintain the crossbow 10 in the drawn position. Similarly, as the bowstring 52 is released and passes a predetermined point in the forward direction generally away from the tailstock 22, the cam assembly 58 may provide a mechanical advantage that serves to enhance the force with which the arrow or projectile is propelled from the crossbow 10. The cam assembly 58 may carry the bowstring 52 and a tension cable assembly 60 in a compound bow arrangement that allows the bowstring 52 to be drawn with an initial force that builds to a maximum limit and thereafter falls off as the crossbow 10 is fully drawn. The use of cams, pulley wheels, and tension cables in a compound bow arrangement with crossbows is well known, and the crossbow 10 may comprise any suitable arrangement of cams, pulley wheels, tension cables or other known compound bow arrangements chosen with sound judgment by a person of ordinary skill in the art.

Figure 3:
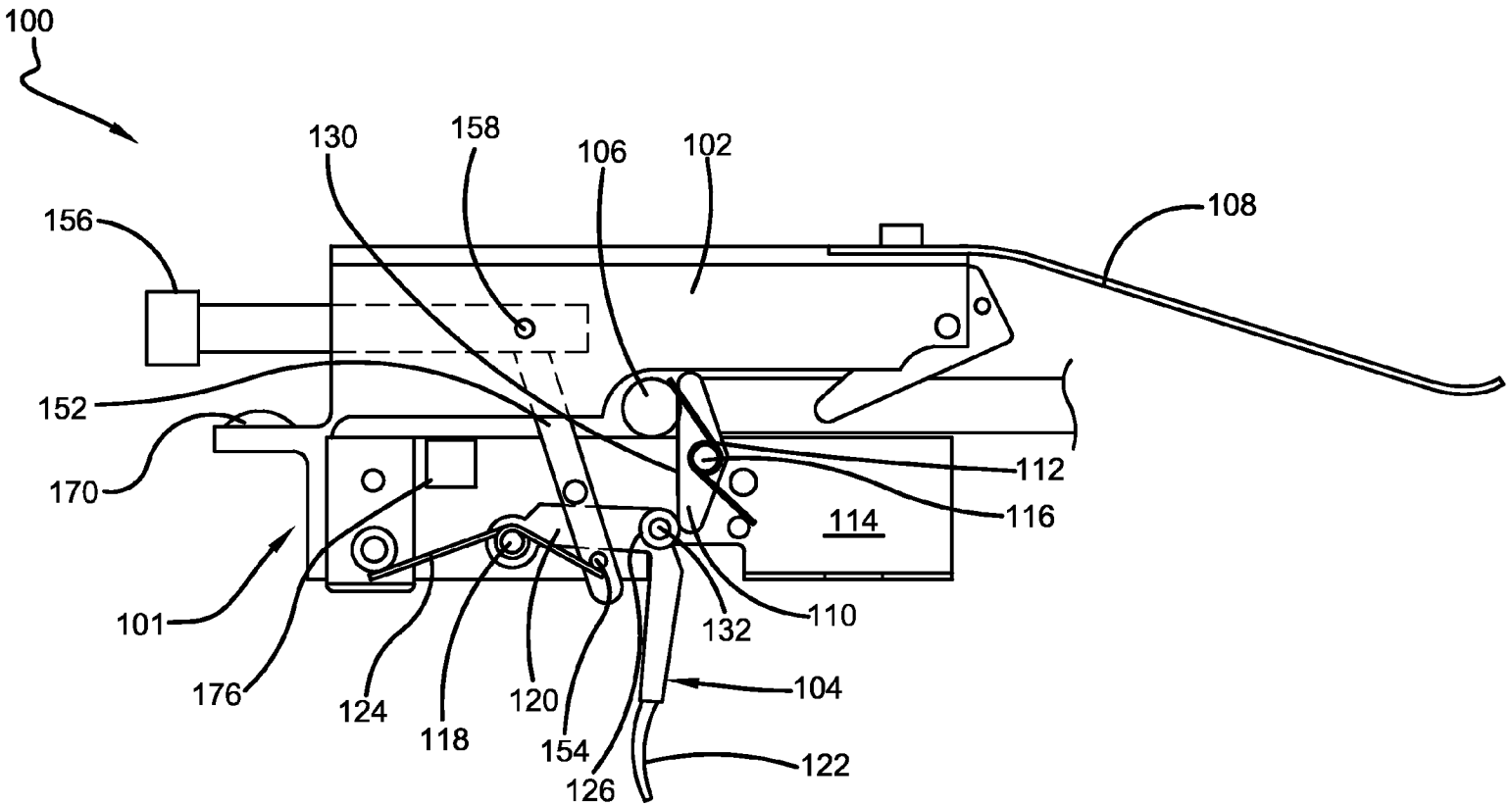
FIG. 3 shows a cutaway view of a trigger assembly comprising a safety device wherein the safety device is engaged, an actuator is in a first actuator position, a pivotal string lever is in a first orientation, a safety lever is in an engaged position, and a trigger lever is in a first trigger position, thereby preventing the firing of the crossbow according to one embodiment of the invention.

With reference now to FIGS. 1, and 3, the trigger assembly 100 may comprise a guide 102, a trigger lever 104, and the safety device 150. The trigger assembly 100 may comprise a separate housing 101 that is mounted to the stock member 20. The housing 101 may hold all of the components of the trigger mechanism 100 to allow it to be completely removed from the stock member 20 for adjustment or repair. Although a particular trigger assembly 100 is shown, the invention may be used with other trigger assemblies chosen with sound judgment by a person of ordinary skill in the art, and the trigger assembly may be provided integral to the stock member 20 or otherwise to eliminate the separate housing 101. The bowstring 52 may be retracted to and held within the guide 102 in the drawn position. The guide 102 may comprise a recess 106, a biasing lever 108, a pivotal spring latch 110, and a latch biasing member 112. The bowstring 52 may be retained substantially within the recess 106 when pulled rearward into the drawn position. In one embodiment, the recess 106 may comprise an oval shape and may be open at one end to permit the bowstring 52 an unobstructed ingress and egress to and from the guide 102. The biasing lever 108 may extend forward from the guide 102 and may urge an arrow or projectile placed on the upper surface 28 of the barrel 24 towards the channel 30. The force imparted by the biasing lever 108 may maintain the arrow or projectile on the upper surface 28 even when the orientation of the crossbow 10 deviates from a horizontal orientation. The pivotal spring latch 110 may maintain the bowstring 52 in the drawn position within the recess 106. The pivotal spring latch 110 may protrude into the recess 106 of the guide 102 between the bowstring 52 in the drawn position and the open end of the recess 106. The pivotal string latch 110 may comprise a metallic or other rigid-material member that contacts the bowstring 52 while the bowstring 52 is in the drawn position within the recess 106. The pivotal string latch 110 may contact the bowstring 52 such that the pivotal string latch 110 acts to block or prevent the release or movement of the bowstring 52 from the guide 102.

With continued reference now to FIGS. 1, and 3, in one embodiment, the pivotal string latch 110 may be pivotally supported between opposing lateral walls 114 of the trigger assembly 100 by a transverse axle 116 extending therebetween. The transverse axle 116 may extend through an aperture formed in the pivotal string latch 110. In another embodiment, the pivotal string latch 110 may be pivotally coupled to any member of the trigger assembly 102 such that the pivotal string latch 110 can pivot on an axis that is generally perpendicular to the direction in which the bowstring 52 is released from the trigger assembly 100. The pivotal string latch 110 may be pivotally adjustable between a first orientation and a second orientation. In the first orientation, the pivotal string latch 110 may contact the bowstring 52 while the bowstring 52 is in the drawn position to interfere with the release of the bowstring 52 from the guide 102. From the first orientation, the pivotal string latch 110 may be pivoted in a clockwise direction about the transverse axle 116 to the second orientation. In the second orientation, the pivotal string latch 110 may be recessed below the surface defining the recess 106 such that the pivotal string latch 110 no longer protrudes into the recess 106. In the second orientation, the pivotal string latch 110 may no longer prevent the bowstring 52 from exiting the recess 106 thereby allowing the energy stored in the flexed limb members 54 to cause the bowstring 52 to exit the recess 106 through the open end. The movement of the bowstring 52 from the recess 106 may cause an arrow or projectile positioned on the upper surface 28 of the stock member 20 to be propelled or fired from the crossbow 10. The latch biasing member 112 may urge the pivotal string latch 110 generally towards the first orientation such that after the bowstring 52 exits the recess 106, the latch biasing member 112 at least partially causes the pivotal string latch 110 to return to the first orientation. In one embodiment, the latch biasing member 112 may comprise a spring, such as a helical or a torsion spring. In another embodiment, the drawing of the bowstring 52 into the guide 102, instead of the latch biasing member 112 at least partially causes the pivotal string latch 110 to return to the first orientation. In yet another embodiment, the drawing of the bowstring 52 in the guide 102 works in conjunction with the latch biasing member 112 to at least partially cause the pivotal string latch 110 to return to the first orientation.

With reference now to FIGS. 1, 3, and 5, the trigger lever 104 may comprise a trigger pin 118, an extended end portion 120, a finger pad 122, a trigger biasing member 124, and a roller assembly 126. The trigger lever 104 may be pivotally coupled to the opposing lateral walls 114 in a manner analogous to that of the pivotal connection of the pivotal string latch 110. In one embodiment, the trigger lever 104 may be pivotally supported between the opposing lateral walls 114 of the trigger assembly 100 by the trigger pin 118 extending therebetween. The trigger pin 118 may extend through an aperture formed in the extended portion 120. The pivotal coupling of the trigger lever 104 may allow the trigger lever 104 to rotate about the trigger pin 118 between a first trigger position, shown in FIG. 3, and a second trigger position, shown in FIG. 4. The trigger biasing member 124 may urge the trigger lever 104 generally towards the first trigger position. In one embodiment, the trigger biasing member 124 may comprise a spring, such as a helical or torsion spring. In another embodiment, the drawing of the bowstring 52 may cause the trigger lever 104 to move to the first trigger position. The roller assembly 126 may comprise at least one generally round or otherwise rollable contact member. In one embodiment, the roller assembly 126 may comprise at least one, and optionally two or more round, rigid wheels that roll over the sear surface 130 as the trigger lever 104 moves from the first trigger position to the second trigger position. The roller assembly 126 may circumferentially extend around a generally cylindrical pin 132. The cylindrical pin 132 may extend transverse to the plane in which the roller assembly 126 rotates.

Figure 4:
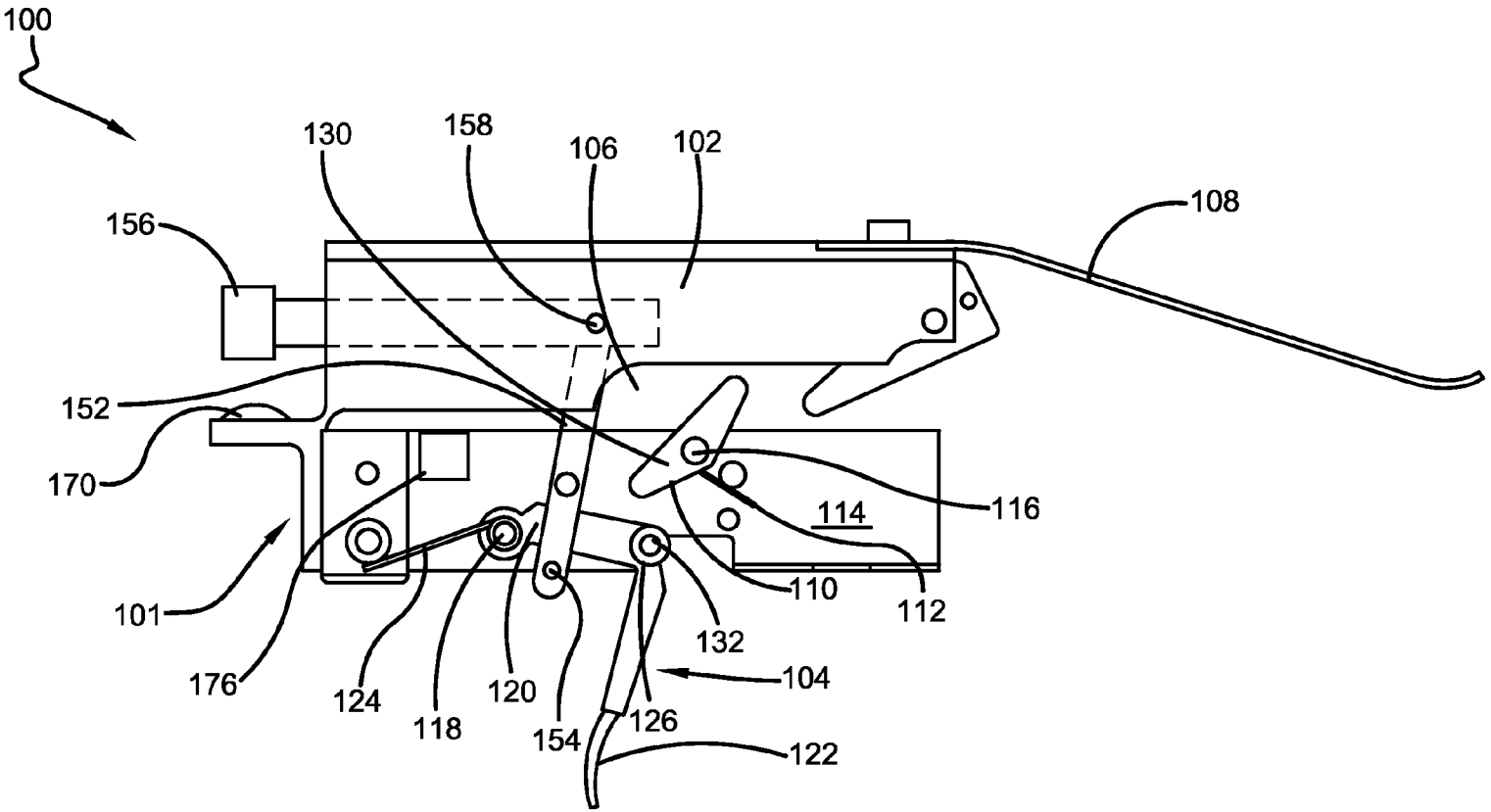
FIG. 4 shows a cutaway view of the trigger assembly shown in FIG. 3 wherein the safety device is not engaged, the actuator is in a second actuator position, the pivotal string lever is in a second orientation, the safety lever is in a forward position, and the trigger lever is in a second trigger position.

With continued reference now to FIGS. 1, 3 and 4, the roller assembly 126 may allow for the adjustment of the position of the trigger lever 104 relative to the pivotal string latch 110 while minimizing the friction therebetween. The placement of the trigger lever 104 in the first trigger position may cause the roller assembly 126 to contact the sear surface 130 thereby preventing the movement of the pivotal string latch 110 from the first orientation to the second orientation. The exertion of a force applied to the finger pad 122 in a generally rearward direction toward the tailstock 22 may cause the trigger lever 104 to rotate about the trigger pin 118 and move from the first trigger position to the second trigger position. The movement of the trigger lever 104 from the first trigger position to the second trigger position may cause the roller assembly 126 to generally roll across the sear surface 130. Once the trigger lever 104 has rotated a predetermined distance in the clockwise direction about the trigger pin 118, the roller assembly 126 may roll off or come out of contact with the sear surface 130. The movement of the roller assembly 126 out of contact with the sear surface 130 may allow the force of the bowstring 52 to cause the pivotal string latch 110 to pivot from the first orientation to the second orientation thereby allowing the bowstring 52 to exit the guide 102.

With continued reference now to FIGS. 1, 3 and 4, in one embodiment the safety device 150 may comprise a safety device that prevents the unintended firing of the crossbow 10 by interfering with the actuation of the trigger lever 104. In another embodiment, the safety device 150 may comprise a safety device that prevents the unintended firing of the crossbow 10 by the transmission of a force imparted on the pivotal string latch 110 thereby preventing the pivotal string latch 110 from moving from the first orientation to the second orientation. The safety device 150 may comprise a safety arm 152, a safety locking pin 154, an actuator 156, and a visual indicator assembly 170. The actuator 156 may be operatively coupled to one end of the safety arm 152 and may comprise a plunger or other device that is selectively movable between a first actuator position, shown in FIG. 3, and a second actuator position, shown in FIG. 4. A transversely extending safety axle 158 may pivotally support the safety arm 152. In one embodiment, the safety arm 152 may be pivotally supported between the opposing lateral walls 114 of the trigger assembly 100 by the safety axle 158 extending therebetween. The safety axle 158 may extend through an aperture formed in the safety arm 152.

With continued reference now to FIGS. 1, 3 and 4, the pivotal coupling of the safety arm 152 may allow the movement of the actuator 156 between the first and second actuator positions to cause the safety locking pin 154 to move into and out of contact with the extended end portion 120. The movement of the actuator 156 to the first actuator position may cause the safety arm 152 to be adjusted to an engaged position, shown in FIG. 3. The safety locking pin 154 may be supported by the safety arm 152 and may extend generally perpendicular through the plane in which the trigger lever 104 rotates about the trigger pin 118. The adjustment of the safety arm 152 to the engaged position may cause the safety locking pin 154 to move into contact with the extended end portion 120 of the trigger lever 104 thereby preventing the rotation of the trigger lever 104 about the trigger pin 118. Stated differently, the application of a generally rearwardly directed force to the finger pad 122 of the trigger lever 104 attempts to cause the trigger lever 104 to rotate about the trigger pin 118. The rotation of the trigger lever 104 would cause the extended end portion 120 to rotate downward about the trigger pin 118, in a clockwise direction. However, when the safety device 150 of the crossbow 10 is engaged by adjusting the actuator 156 to the first actuator position, the safety locking pin 154 contacts the extended end portion 120, thereby preventing the clockwise rotation of the extended end portion 120 and the rest of the trigger lever 104. Thus, the release of the bowstring 52 from the guide 102 is prevented even if a typical force required to bring about said release is imparted on the finger pad 122 of the trigger lever 104. The movement of the actuator 156 to the second actuator position may cause the safety arm 152 to be adjusted to a forward position, shown in FIG. 4. The adjustment of the safety arm 152 to the forward position may cause the safety locking pin 154 to move out of contact with the extended end portion 120 of the trigger lever 104 thereby allowing the trigger lever 104 to rotate about the trigger pin 118.

With reference now to FIGS. 2, 3, and 4, the visual indicator assembly 170 may provide the user with an easily identifiable means for determining whether the safety device 150 is engaged. The visual indicator assembly 170 may comprise a first indicator 172, a second indicator 174, and a power supply 176. In one embodiment, the first and second indicators 172, 174 may be positioned on the upper rear surface of the guide 102 such that they may be easily and conveniently viewed by a user preparing to fire the crossbow 10. In another embodiment, the first and second indicators 172, 174 may be positioned on the stock member 20 adjacent to the actuator 156. The first and second indicators 172, 174 may be positioned in any location such that they may be easily and conveniently viewed when the crossbow 10 is positioned against the shoulder of the user when preparing to fire the crossbow 10. The first and second indicators 172, 174 may each comprise a light source that emits a colored light when placed in electrical communication with the power supply 176. In one embodiment, the first and second indicators 172, 174 may each comprise a point light source such as a light emitting diode (LED). The first and second indicators 172, 174 may comprise any type of light source chosen with sound judgment by a person of ordinary skill in the art. In one embodiment, the first indicator 172 may emit a white light and the second indicator 174 may emit a red or amber colored light. The first and second indicators 172, 174 may emit any colored light chosen with sound judgment by a person of ordinary skill in the art.

With continued reference now to FIGS. 2, 3, and 4, the movement of the actuator 156 to the first actuator position may cause the safety device 150 to be engaged. The movement of the actuator 156 to the first actuator position may cause the safety device 150 to be engaged by causing the safety locking pin 154 to contact the extended end portion 120 thereby preventing the movement of the trigger lever 104 as described above. Further, the movement of the actuator 156 to the first actuator position may cause the first indicator 172 to be in electrical communication with the power supply 176 thereby causing the first indicator 172 to be illuminated. In one embodiment, the first indicator 172 may emit a white light thereby indicating that the safety device 150 is engaged thereby preventing the release of the bowstring 52. The movement of the actuator 156 to the second actuator position may cause the safety device 150 to be disengaged. The movement of the actuator 156 to the second actuator position may cause the safety device 150 to be disengaged by causing the safety locking pin 154 to move out of contact with the extended end portion 120 thereby allowing the trigger lever 104 to be rotated and the bowstring 52 to be released as described above. Further, the movement of the actuator 156 to the second actuator position may cause the second indicator 174 to be in electrical communication with the power supply 176 thereby causing the second indicator 174 to be illuminated. In one embodiment, the second indicator 174 may emit a red or amber colored light thereby indicating that the safety device 150 is disengaged and that the actuation of the trigger lever 104 will cause the bowstring 52 to be released. In another embodiment, the second indicator 174 may emit a flashing red light wherein the second indicator 174 is caused to periodically illuminate thereby periodically emitting or flashing a red light. By emitting a flashing red light, the second indicator 174 may utilize less power thereby allowing an integrated power supply 176 to have extended period of use.

With continued reference now to FIGS. 2, 3, and 4, in one embodiment, the safety locking pin 154 may comprise a conductor and may be in electrical communication with the power supply 176. The movement of the actuator 156 between the first and second actuator positions and the corresponding movement of the safety locking pin 154 may cause the safety locking pin 154 to move between a first and a second set of electrical contacts 178, 180. When the safety device 150 is engaged, the actuator 156 positioned in the first actuator position, the safety locking pin 154 may contact the first set of electrical contacts 178 thereby causing the first indicator 172 to be in electrical communication with the power supply 176. When the safety device 150 is disengaged, the actuator 156 positioned in the second actuator position, the safety locking pin 154 may contact the second set of electrical contacts 180 thereby causing the second indicator 174 to be in electrical communication with the power supply 176. In another embodiment, a third electrical contact 182 may be positioned on the actuator 156 within the trigger assembly 100 such that the movement of the actuator 156 may cause the third electrical contact 182 to move between the first and second set of electrical contacts 178, 180 in a similar manner as described above. Any method for causing the first and second indicators 172, 174 to move in and out of electrical communication with the power supply 176 in conjunction with the engagement and disengagement of the safety device 150 is contemplated as being within the scope of this invention.

With reference now to FIGS. 1-4, in one embodiment, the power supply 176 may be positioned within the trigger assembly 100. In another embodiment, the power supply 176 may be positioned within the stock member 20. The visual indicator assembly 170 may further comprise a power switch 184 for allowing the user to prevent the illumination of the first and second indicators 172, 174. In one embodiment, the power switch 184 comprises a switch that can be opened and closed via an aperture formed in the trigger assembly 100. In another embodiment, the power switch 184 comprises a switch that can be opened and closed via an aperture formed in the stock member 20. The power switch 184 may be located adjacent to the trigger lever 104 such that the user may use the same finger to open and close the power switch 184 as used to actuate the trigger lever 104. In yet another embodiment, the power switch 184 comprises an external switch that can be mounted to the crossbow 10 or carried separately by the user. In another embodiment, the crossbow 10 may comprise a dry fire inhibitor (DFI) 200. The DFI 200 may prevent the bowstring 52 from being released by the trigger assembly 100 unless an arrow or projectile is positioned to be fired from the crossbow 10. Additionally, the visual indicator assembly 170 may comprise a third indicator 202 for indicating the deactivation of the DFI 200. In one embodiment, the deactivation of the DFI 200 may cause the third indicator 202 to be in electrical communication with the power supply 176 thereby causing the third indicator 202 to emit a colored light, for example a green light, that indicates the deactivation of the DFI 200.

With continued reference now to FIGS. 1-4, in one embodiment, the first and second indicators 172, 174 may each comprise a colored component that is raised from a position within the trigger assembly 100 in conjunction with the movement of the actuator 156 between the first and second actuator positions respectively. Alternatively, the colored components 172, 174 may be raised from a position within the stock member 20. In one embodiment, the movement of the actuator 156 may cause a bi-directional motor assembly 204 to be in electrical communication with the power supply 176 thereby causing the raising and lowering of the colored components 172, 174. In another embodiment, the movement of the actuator 156 may cause a raised knob 206 positioned on the elongated portion of the actuator 156 to move between contacting the first and second colored components 172, 174. The movement of the actuator 156 into the first actuator position may cause the raised knob 206 to move into contact with the first colored component 172. The movement of the raised knob 206 into contact with the first colored component 172 may cause the first colored component 172 to be raised upward and extend through an aperture formed in the guide 102. The subsequent movement of the actuator 156 into the second actuator position may cause the raised knob 206 to move out of contact with the first colored component 172 and into contact with the second colored component 174 thereby causing the first colored component 172 to be lowered through the aperture to a position located within the trigger assembly 100 and the second colored component 174 to be raised upward and extend through a second aperture formed in the guide 102.

The embodiments have been described, hereinabove. It will be apparent to those skilled in the art that the above methods and apparatuses may incorporate changes and modifications without departing from the general scope of this invention. It is intended to include all such modifications and alterations in so far as they come within the scope of the appended claims or the equivalents thereof.

What is claimed is:

1. A crossbow comprising:

a stock member;

a bow portion comprising first and second limb members that extend transversely on opposite sides from the stock member;

a trigger assembly supported to the stock member for selectively holding and releasing a bowstring strung between the distal ends of the first and second limb members; wherein the trigger assembly comprises a trigger that is movable with respect to the stock member to cause the trigger assembly to release the bowstring to fire an associated projectile;

a safety device that is supported to the stock member and adjustable into: (1) a first condition where the trigger is prevented from being moved with respect to the stock member to cause the trigger assembly to release the bowstring to fire the associated projectile; and, (2) a second condition where the trigger is permitted to be moved with respect to the stock member to cause the trigger assembly to release the bowstring to fire the associated projectile;

a visual indicator assembly that comprises: an electric power supply; and, a first indicator; and, wherein (1) when the safety device is adjusted into one of the first and second conditions, the electric power supply is electrically connected to the first indicator to cause the first indicator to emit light; and, (2) when the safety device is adjusted into the other of the first and second conditions, the electric power supply is not electrically connected to the first indicator and the first indicator does not emit light.

2. The crossbow of claim 1 wherein:

the visual indicator assembly comprises a second indicator;

when the safety device is adjusted into the first condition: (1) the electric power supply is electrically connected to the first indicator to cause the first indicator to emit light; and, (2) the electric power supply is not electrically connected to the second indicator and the second indicator does not emit light; and, when the safety device is adjusted into the second condition: (1) the electric power supply is electrically connected to the second indicator to cause the second indicator to emit light; and, (2) the electric power supply is not electrically connected to the first indicator and the first indicator does not emit light.

3. The crossbow of claim 1 wherein:

the safety device comprises an actuator connected to an arm;

the safety device is adjusted into the first condition by moving the actuator with respect to the stock member to cause the arm to contact the trigger; and, the safety device is adjusted into the second condition by moving the actuator with respect to the stock member to cause the arm to come out of contact with the trigger.

4. The crossbow of claim 3 wherein:

the crossbow has a longitudinal axis that is parallel to the direction the associated projectile is fired when the bowstring is released;

the actuator is pivotally connected to the arm;

the arm is pivotally connected to the crossbow;

the safety device is adjusted into the first condition by moving the actuator longitudinally in a first longitudinal direction with respect to the stock member to cause the arm to pivot in a first pivot direction with respect to the crossbow to cause the arm to contact the trigger; and, the safety device is adjusted into the second condition by moving the actuator longitudinally in a second longitudinal direction that is opposite the first longitudinal direction with respect to the stock member to cause the arm to pivot in a second pivot direction that is opposite the first pivot direction with respect to the crossbow to cause the arm to come out of contact with the trigger.

5. The crossbow of claim 1 wherein:

the safety device comprises an actuator connected to an arm having a portion that is an electric conductor;

the safety device is adjusted into the first and second conditions by moving the actuator with respect to the stock member to cause the arm to move with respect to the stock member;

when the safety device is adjusted into the one of the first and second conditions that causes the first indicator to emit light, the arm is positioned with the electric conductor communicating electricity between the electric power supply and the first indicator; and, when the safety device is adjusted into the other of the first and second conditions, the arm is positioned with the electric conductor not communicating electricity between the electric power supply and the first indicator.

6. A crossbow comprising:

a stock member;

a bow portion comprising first and second limb members that extend transversely on opposite sides from the stock member;

a trigger assembly supported to the stock member for selectively holding and releasing a bowstring strung between the distal ends of the first and second limb members; wherein the trigger assembly comprises a trigger that is movable with respect to the stock member to cause the trigger assembly to release the bowstring to fire an associated projectile;

a safety device that is supported to the stock member and comprises an arm;

wherein the arm is movable with respect to the stock member into: (1) a first position where the arm contacts the trigger to prevent the trigger from being moved with respect to the stock member to cause the trigger assembly to release the bowstring to fire the associated projectile; and, (2) a second position where the arm does not contact the trigger to permit the trigger to be moved with respect to the stock member to release the bowstring to fire the associated projectile;

a visual indicator assembly supported to the stock member that comprises: an electric power supply; a first indicator; and, a second indicator;

wherein when the arm is moved into the first position: (1) the electric power supply is electrically connected to the first indicator to cause the first indicator to emit light; and, (2) the electric power supply is not electrically connected to the second indicator and the second indicator does not emit light; and, wherein when the arm is moved into the second position: (1) the electric power supply is electrically connected to the second indicator to cause the second indicator to emit light; and, (2) the electric power supply is not electrically connected to the first indicator and the first indicator does not emit light.

7. The crossbow of claim 6 wherein:

the arm has a portion that is an electric conductor;

when the arm is moved into the first position the electric conductor communicates electricity between the electric power supply and the first indicator; and, when the arm is moved into the second position the electric conductor communicates electricity between the electric power supply and the second indicator.

8. The crossbow of claim 7 wherein:

the crossbow has a longitudinal axis that is parallel to the direction the associated projectile is fired when the bowstring is released;

the arm is pivotal with respect to the stock member into the first and second positions;

the safety device further comprises an actuator that is pivotally connected to the arm;

the arm is moved into the first position by moving the actuator longitudinally in a first longitudinal direction with respect to the stock member to cause the arm to pivot in a first pivot direction with respect to the crossbow to cause the arm to contact the trigger; and, the arm is moved into the second position by moving the actuator longitudinally in a second longitudinal direction that is opposite the first longitudinal direction with respect to the stock member to cause the arm to pivot in a second pivot direction that is opposite the first pivot direction with respect to the crossbow to cause the arm to come out of contact with the trigger.

9. The crossbow of claim 8 wherein:

the first indicator emits light of a first color; and, the second indicator emits light of a second color that is substantially different that the first color.

* * * * *